US009051685B2

(12) United States Patent
Karvinen et al.

(10) Patent No.: US 9,051,685 B2
(45) Date of Patent: Jun. 9, 2015

(54) METHOD AND APPARATUS FOR REDUCING THE WATER AND ENERGY CONSUMPTION OF A PAPER MACHINE WITH THE HELP OF A VACUUM SYSTEM AND OPTIMIZATION OF SOLIDS CONTENT AS WELL AS USE OF THE SAME

(71) Applicant: RUNTECH SYSTEMS OY, Kolho (FI)

(72) Inventors: Juha Karvinen, Siltakylä (FI); Kimmo Loippo, Kolho (FI)

(73) Assignee: RUNTECH SYSTEMS OY, Kolho (FI)

( * ) Notice: Subject to any disclaimer, the term of this patent is extended or adjusted under 35 U.S.C. 154(b) by 0 days.

(21) Appl. No.: 14/351,085

(22) PCT Filed: Oct. 5, 2012

(86) PCT No.: PCT/FI2012/050960

§ 371 (c)(1),
(2) Date: Apr. 10, 2014

(87) PCT Pub. No.: WO2013/053993

PCT Pub. Date: Apr. 18, 2013

(65) Prior Publication Data

US 2014/0231038 A1 Aug. 21, 2014

(30) Foreign Application Priority Data

Oct. 11, 2011 (FI) ..... 20115998

(51) Int. Cl.
*D21F 1/50* (2006.01)
*D21F 1/32* (2006.01)
(Continued)

(52) U.S. Cl.
CPC .. *D21F 1/50* (2013.01); *D21F 1/32* (2013.01); *D21F 1/52* (2013.01); *D21F 3/04* (2013.01); *D21F 3/10* (2013.01); *D21F 5/20* (2013.01); *D21F 7/003* (2013.01)

(58) Field of Classification Search
USPC ..... 162/210
See application file for complete search history.

(56) References Cited

U.S. PATENT DOCUMENTS 5,468,349 A 11/1995 Schiel
5,582,687 A * 12/1996 Odell et al. ..... 162/203
(Continued)

FOREIGN PATENT DOCUMENTS

CN 201245793 Y 5/2009
FI 121605 B 1/2011

OTHER PUBLICATIONS

Hannu Paulapuro, Papermaking Science and Technology, Papermaking Part 1, Stock Preparation and Wet End. Fapet Oy. julkaisuaika: Printed by Gummerus Printing, Jyväskylä, Finland 2000.
(Continued)

*Primary Examiner* — Jacob Thomas Minskey
(74) *Attorney, Agent, or Firm* — Birch, Stewart, Kolasch & Birch, LLP

(57) ABSTRACT

A method for reducing the water and energy consumption of a paper machine with the help of a vacuum system and optimization of web solids content. On the paper machine wire section, water is removed with the help of a hybrid vacuum system serving first the vacuum locations needing a lower vacuum level and then those requiring a higher vacuum level in such fashion that the hybrid vacuum system removes water on different sections of the paper machine at the vacuum levels rendering the individually maximized energy efficiency. Additionally the solids content on the wire section is optimized with the help of an unfelted and smooth press roll adapted above the wire suction roll.

12 Claims, 7 Drawing Sheets
(1 of 7 Drawing Sheet(s) Filed in Color)

(51) Int. Cl.

| | |
|---|---|
| ***D21F 1/52*** | (2006.01) |
| ***D21F 3/04*** | (2006.01) |
| ***D21F 3/10*** | (2006.01) |
| ***D21F 5/20*** | (2006.01) |
| ***D21F 7/00*** | (2006.01) |

(56) References Cited

U.S. PATENT DOCUMENTS

| | | | |
|---|---|---|---|
| 5,792,320 | A | 8/1998 | Kaasalainen et al. |
| 5,908,536 | A | 6/1999 | Kaasalainen et al. |
| 2006/0283569 | A1 | 12/2006 | Wildfong et al. |

OTHER PUBLICATIONS

Vacuum Systems for the Paper Industry, NASH Gardner Denver Engineered Products Div., julkaisuaika: 2004 [haettu 12.3 2012]. Internetosoitteesta: http://www.gdnash.com/industrycategorylist.aspx?id=11172.

* cited by examiner

3 Wire suction roll
4 Water ring pump
5 Paper machine
7 Seal water
9 Water separator
12 Wire section
13 Press suction roll
17 Flat suction box

METHOD AND APPARATUS FOR REDUCING THE WATER AND ENERGY CONSUMPTION OF A PAPER MACHINE WITH THE HELP OF A VACUUM SYSTEM AND OPTIMIZATION OF SOLIDS CONTENT AS WELL AS USE OF THE SAME

CROSS-REFERENCE TO RELATED APPLICATIONS

The present application claims priority under 35 USC 119 to Finnish Patent Application No. 20115998 filed on Oct. 20, 2011 and PCT Patent Application No. PCT/FI2012/050960, filed Oct. 5, 2012, the entire contents of which are hereby incorporated by reference.

BACKGROUND OF THE INVENTION

1. Field of the Invention

The invention relates in accordance with a method for reducing the water and energy consumption of a paper machine with the help of a vacuum system and optimization of solids content. Furthermore, the invention relates to the use of an apparatus and a hybrid vacuum system.

2. Description of Background Art

As is generally known, a papermaking process is highly energy-intensive. The greatest energy consumers can be basically listed as the heating of raw materials, pump units at the wet end and the dryer section itself.

In the heating of raw materials for papermaking, fiber and fillers are taken to the paper mill from outdoors storage. Hence, they must be heated to the process temperature of 40-50 degrees centigrade The stock is mixed with water, whose amount typically by weight is 10 to 20 times greater than the amount of wood fiber and filler materials in the resulting production furnish (furnish consistency in the headbox is generally 0.3-1 percent, max. 2 percent, which translates into 1 part of fiber and similar solids in 99-300 parts of water). This water volume is recirculated in the process even if the process does not have a closed circulation system. Water consumption per produced ton of paper is about 10-20 m3/t. The necessary amount of water is generally taken from a lake/river at a temperature of 0-25 degrees centigrade, depending on the season of the year. Today, the process temperature is elevated up to 40-50 degrees centigrade in order to improve dewatering drainage. Hence, the effluent water passed from the mill to wastewater treatment contains a great amount of low-value thermal energy whose recovery concurrently is unprofitable or complicated.

Additionally, papermaking needs a lot of air that also must be heated. Many mills use large volumes of hot air which is exhausted from the process without being utilized by heat recovery.

The above-mentioned great amount of circulation water requires massive pumping power that is another major energy consumer. Eventually, this energy is converted into heat thus providing a major portion of the thermal energy required by the process. Drying the paper web on the wire and press sections is partially implemented with the help of vacuum. This portion of the process is known as the process vacuum system. Also the vacuum system is a prominent energy user that typically consumes 20 percent of the mill's overall power.

After passing through the wire and press sections, the solids content of the paper web is generally in the range of 40-50 percent. The final moisture content of the paper web is 6-8 percent. Drying the web after the press takes place by evaporation. Evaporation of water is a highly intensive consumer of energy that is obtained from steam. Hence, the solids content of the paper web is advantageously maximized upstream of the dryer section in order to minimize steam consumption.

As said, an important portion of a paper machine is its vacuum system. The vacuum systems of a paper machine can be divided into two basic arrangements: a water ring pump system and a turboblower system.

In FIG. 1 is illustrated a typical paper machine equipped with water ring pumps. The drawing also shows conventional dewatering equipment of a paper machine that will be discussed later in the text. The system generally comprises pumps with 6-15 pieces that serve the locations of the paper machine 5 requiring vacuum at different sub-atmospheric pressure levels. In a water ring pump 4, the rotating water acts as a piston that compresses the entering gas. The compression takes place isothermally, whereby the thermal energy released from compression is mainly absorbed by the seal water passed into the pump 4. A great amount of seal water is required, 100-400 l/min per pump, but 80-90 percent thereof can be recirculated if elevation of water temperature can be prevented through cooling the liquid circulation. However, there will be lost the thermal energy recoverable from the compression cycle, and also from a portion of the heat released in the process. As the spent seal water contains fiber and impurities, it is generally passed out from the mill's water circulation. The overall efficiency of a water ring pump 4 is dependent on the vacuum level and pump rotation speed. Efficiency at a high vacuum is better than at low vacuum.

Alternatively, the vacuum system in paper machines can be implemented with centrifugal blowers of the type generally known as turboblower. The vacuum locations in a paper machine are generally operated at a high vacuum in excess of 60 kPa. Hereby one or two multistage blowers are required to reach the highest vacuum levels. The number of stages, or impellers, arranged in series is typically four pieces. Generally, at each impeller is arranged an intermediate port for connection to lower vacuum locations. The capacity of this blower type cannot be varied by changing the speed of rotation. The only possible way of adjustment is by throttling the air flow. In terms of energy efficiency, this kind of capacity control is uneconomical. Additionally, the system also has at least one single-stage blower for medium vacuum locations. As the exhaust air from the blower system is hot, its thermal energy can be recovered by heat exchangers.

In FIG. 2 is illustrated a typical turboblower system. The pumping efficiency of a turboblower system is slightly better than that of a water ring pump 4. On the other hand, when the system has a smaller number of blowers, the flows to the vacuum locations must be controlled with throttle valves, whereby the overall efficiency of the system is impaired. The greatest benefit is appreciated therein that the blower has no rotating water ring, i.e., it does not need seal water at all. In contrast, a significant problem arises from cost of the system due to the multistage blowers, whose higher price of acquisition and installation together with their auxiliary equipment increase the investment costs.

In addition to the above systems, the dewatering equipment of a paper machine is a vital element. On the wire section 12, water is initially removed from the web by gravitation and with foil effects and centrifugally. Thereupon more differential pressure must be applied across the web, since a major portion of water is transferred from the paper web to the dewatering equipment by compression. Typically, downstream of the felt water level are arranged flat suction boxes 17 having a vacuum therein. At the end of the wire section 12 is generally located a suction roll. In FIG. 3 is shown the conventional construction and operating principle of flat suction boxes 17 and wire suction roll 3.

The vacuum system produces the vacuum in the flat suction boxes and the wire suction roll. Air flows into the suction boxes 17 through the web, whereby a pressure differential is established. This function is highly energy-intensive. The pressure differential causes friction between the suction box 17 and wire section 12, thus increasing the energy consumption of the wire drive motors. Water is removed from the paper web partially along with the air flow, but also due to caliper compression of the web, particularly for thicker paper grades having a basis weight greater than 80 g/m2.

The wire suction roll 3 has holes 15 drilled thereto for suction of air through the web. The passing-through air does not retard the web travel but requires more capacity from the vacuum pumps due to the elevated vacuum level and additional air sucked through the drilled holes 15. Water is collected from the web through the wire into the holes 15 of the roll 3, wherefrom it is ejected centrifugally to a water collection pan adapted about the roll. In practice has been found that no water will pass through the holes 15 of the suction roll 3 if the web speed exceeds 200 m/min. Another practical experience relates to the crucial role of the pan as all water ejected from the roll 3 must be collected into the pan, wherefrom it is returned to the water circulation of the machine. Since the water tends to adhere to the surface of the suction roll 3 and holes 15 due to surface forces, it must be separated with the help of different doctoring arrangements.

It must be noted that while no fresh water is needed for the suction box 17, the wire suction roll 3 consumes water by about 100-200 l/min as lubrication for the seal strips of the vacuum chamber 14 of the wire suction roll 3.

Typical solids content after the wire is 15-20 percent. Solids content is preferably maximized in order to minimize energy consumption at the later discussed press and dryer sections, simultaneously achieving improved machine runnability. A general rule of thumb in the art is that in paper webs a change of 1 percent downstream of the wire section 12 results in 0.25 percent increase in solids downstream of the press section.

In the appended FIG. 4 are shown the results of a study performed by Ph.D. Raeisaenen on the effect of vacuum level and dwell time on the solids content downstream of the wire section. The diagram is reprinted from the annual report 1994 of research program Sustainable Paper (Kestaevae Paperi). As has also found in practice, the diagram clearly indicates the optimum running condition, namely, that the vacuum level must increase toward the trailing end of the wire travel. Another important aspect relates to the maximum solids content attainable at a given pressure differential. As a longer dwell time cannot offer a higher solids content, a higher vacuum level must be applied. Since a vacuum level of about 70 kPa is a practical maximum, compression must be applied to the web downstream of the wire section 12 in order to reach a higher solids content. Down-stream of the wire section on the press section, this function is implemented with the help of presses that remove water from the web to felts and/or holes 15 of the suction roll 3 and/or grooves of a grooved roll. In some paper machines, a press and endless felt are adapted above a suction roll. This arrangement typically achieves a solids content of about 24 percent downstream of the wire section 12.

As elucidated above, running a paper machine involves an extremely great number of factors affecting water and energy consumption. In prior-art arrangements the goal has been to solve one problem at a time. Now the present invention attempts to find a solution by way of examining all the different factors separately and then combining their effect in the overall performance. This approach proved that in the art there still are substantial possibilities of improvement in the various properties of a paper machine. The essential feature of the invention is particularly a reduced consumption of water and energy by virtue of an improved vacuum system and optimization of web solids content. Resultingly, the invention offers reduced energy consumption in a paper machine through increased solids content downstream of the wire and press section and, further, by reducing raw water consumption in the mill. This goal is attained by utilizing conventional equipment in an entirely novel and innovative fashion and enhancing the operating practices of the paper machine 5. In addition to the economic benefit resulting therefrom, the invention facilitates reduced investment costs with regard to the present situation.

The essential features of the present invention are crucial factors in the arrangement defined in the claims. The present invention provides plural significant benefits, while simultaneously avoiding the problems hampering the prior art as discussed above.

The arrangement according to the invention implemented using a so-called hybrid vacuum system, whereby a significant improvement is achieved in the energy consumption of the paper machine in its front end, on its wire section through reduced water and electricity consumption and increased web solids content. A significant feature is that the invention aims to provide a comprehensive improvement of energy consumption rather than simply attempting enhanced energy use in a single component such as a pump.

BRIEF DESCRIPTION OF THE DRAWINGS

More specifically, the invention is characterized by what is disclosed in the appended claims. The invention is next described in more detail by making reference to the annexed drawings wherein The patent or application file contains at least one color drawing. Copies of this patent or patent application publication with color drawing will be provided by the USPTO upon request and payment of the necessary fee.

DETAILED DESCRIPTION OF THE PREFERRED EMBODIMENTS

Figure 1:
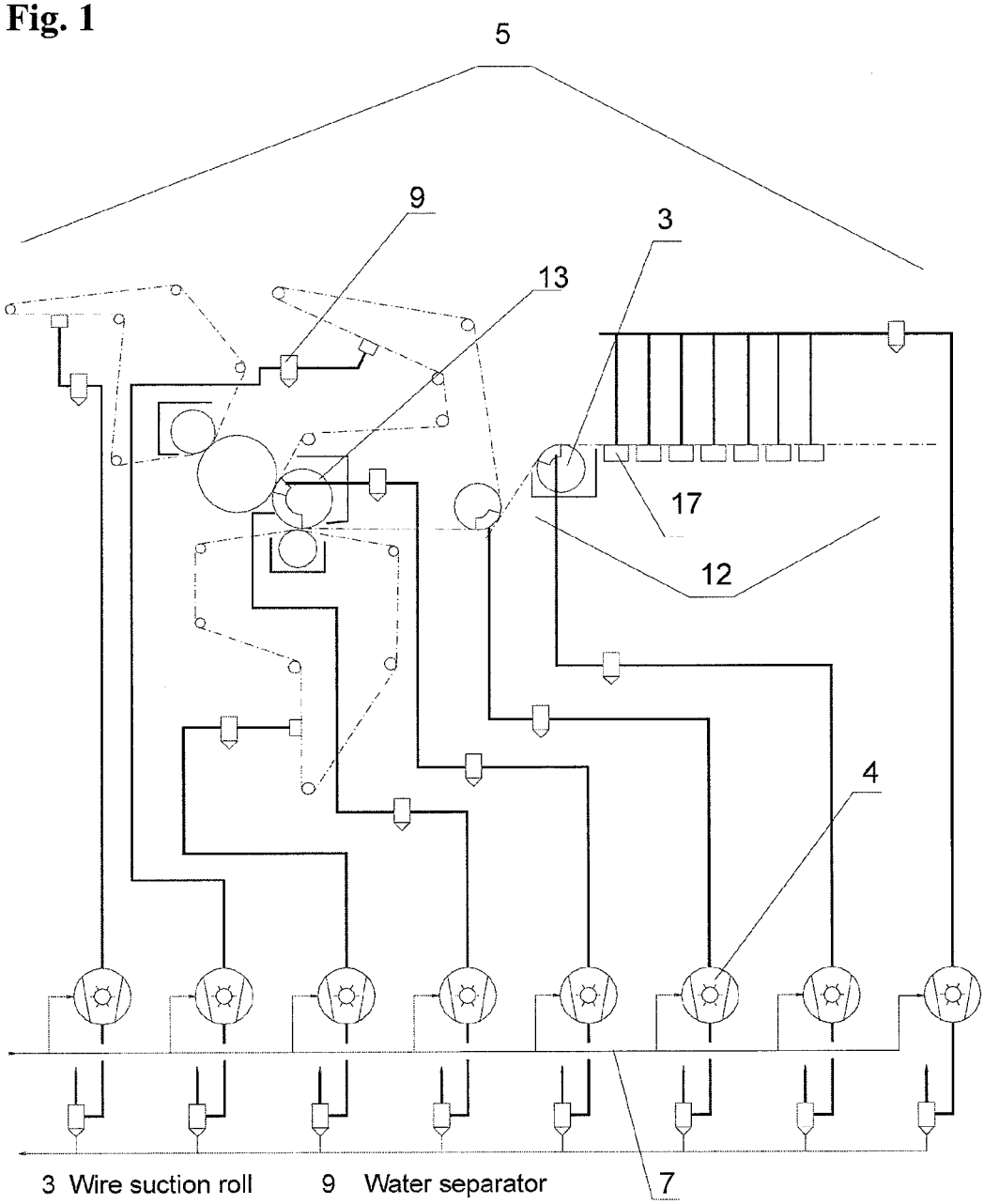
FIGS. 1-3 show some embodiments of prior-art constructions.

The above-discussed conventional vacuum system implemented with the help of turboblowers 10 does not consume water at all. However, the system is hampered by the costly multistage blowers that are required to achieve the high vacuum levels needed in a paper machine, as well as by the energy-wasting throttle control. In the embodiment according to the invention, a so-called hybrid vacuum system 1 is configured, said vacuum system being implemented primarily with cost-effective single-stage or two-stage blowers 2. The blower impellers are mounted on the motor shaft, which also makes facilitates the capacity control of a possible two-stage blower by varying the rotation speed. An essential detail herein is that said blowers are used for serving only those vacuum locations of the paper machine that can utilize their salient energy efficiency, typically at a vacuum level of 0-60 kPa, namely, all other vacuum locations except wire suction roll 3 and wire (and unfelted) press roll 13 requiring a higher vacuum. To serve the suction rolls that require an elevated vacuum level, a water ring pump 4 is used that for generation of a high vacuum is a very good and energy-efficient device. No water separation is provided between the water ring pump 4 and paper machine 5, since only clean lubrication water 6 of the seal strips is pumped therein. The seal strip lubrication water travels to the water ring pump 4, wherein it is used as seal water 7 of the pump. This water volume, however, is not sufficient to the function of the water ring pump 4 as its flow also varies according to the running conditions of the paper machine. Hence, a certain amount of supplementary water 8 must be introduced. Since the function of the water ring pump 4 presumes a correct amount of seal water, the flow of water must be controlled in the following fashion: downstream of the pump is installed a water separator 9 whose water volume is measured. This measurement is used to control the amount of supplementary water 8 to be delivered to the pump as shown in appended FIG. 5. An alternative method of controlling the admission of supplementary water to the pump is to measure the temperature of the pump 4 that begins to arise if the amount of seal water is insufficient.

As no process water is discharged from the wire suction roll 3, the water coming out from water separator 9 is clean. The water temperature has risen in the pump 4 and can thus be passed to the process or used as cleaning shower water that must be warm. Accordingly, the water consumption in the factory is decreased and its thermal energy can be recovered. Other vacuum locations of the paper machine can be served by speed-controlled turboblowers 10 having single-stage or maximally two-stage construction. Speed control is the most energy-efficient control method, which lowers the mill's operating costs. The outcome is an especially energy-efficient hybrid system that provides significant savings in water consumption. By virtue of the hybrid vacuum system, electricity consumption is typically reduced by about 30 percent.

Figure 2:
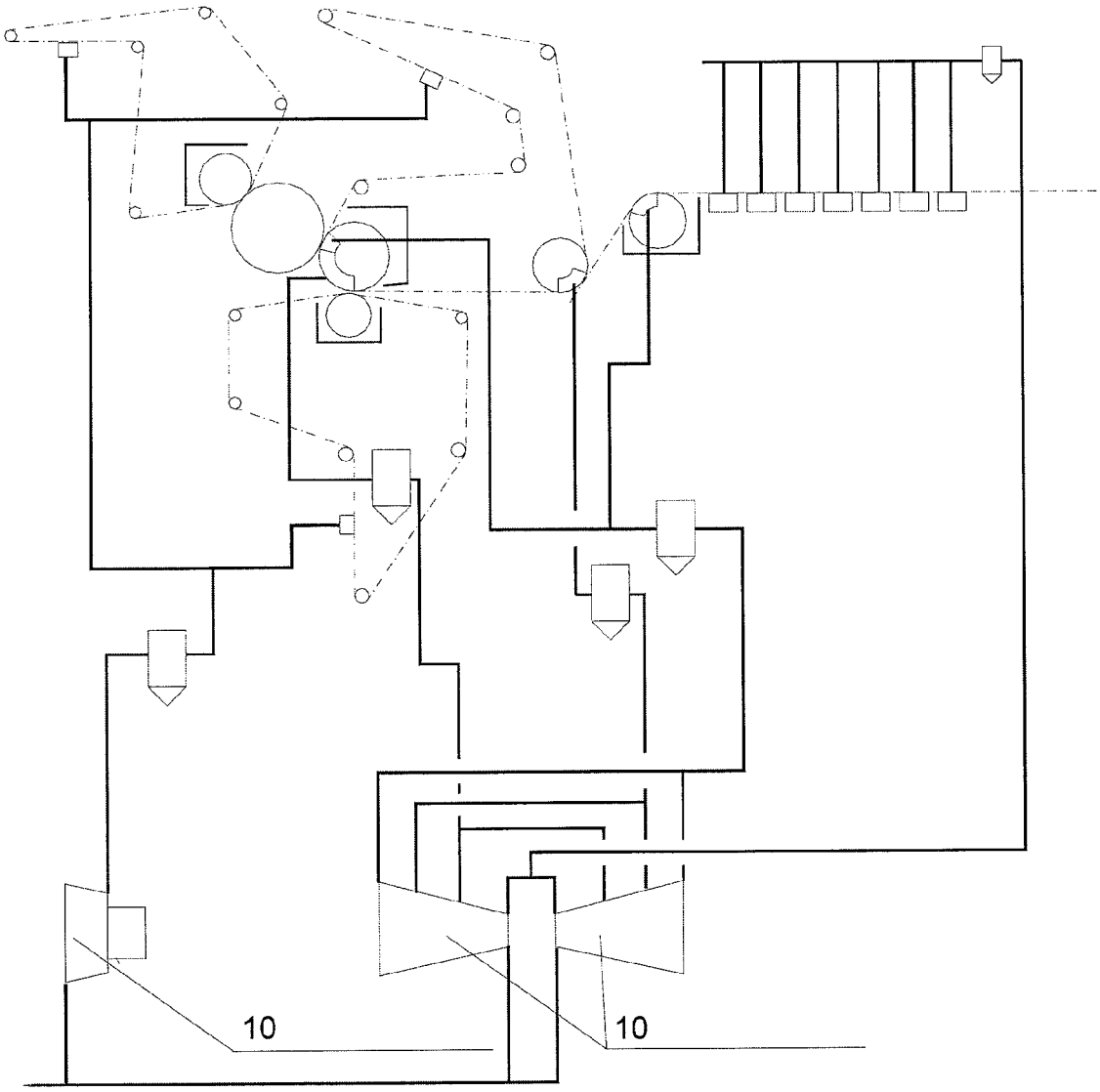
Figure 3:
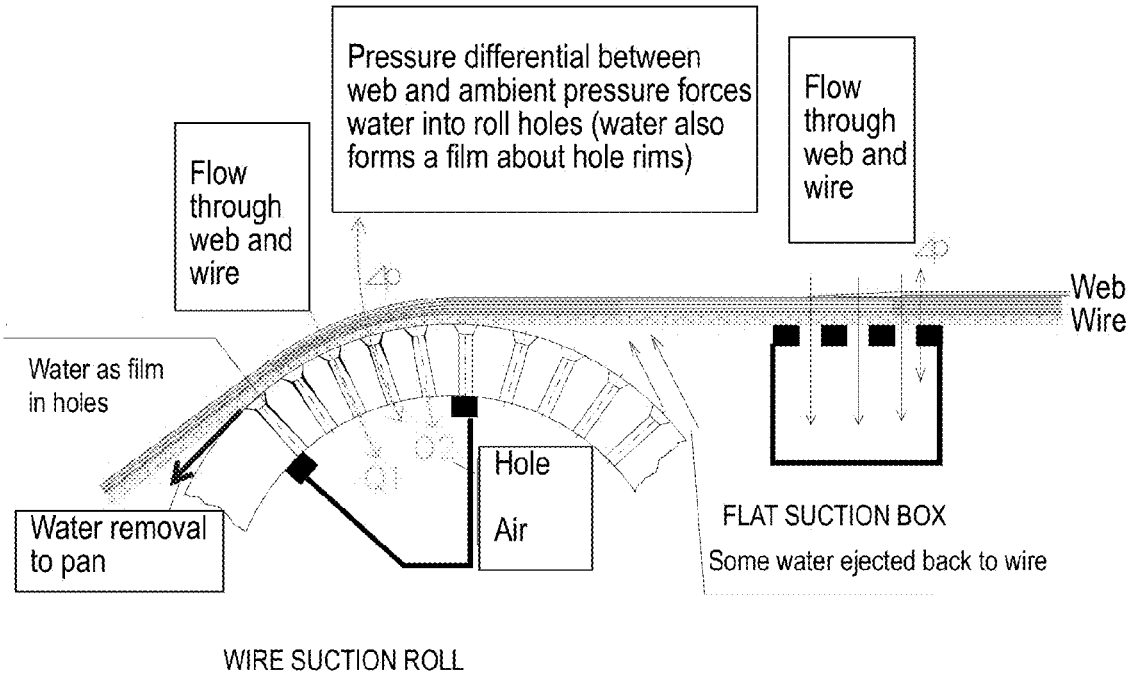
Figure 4:
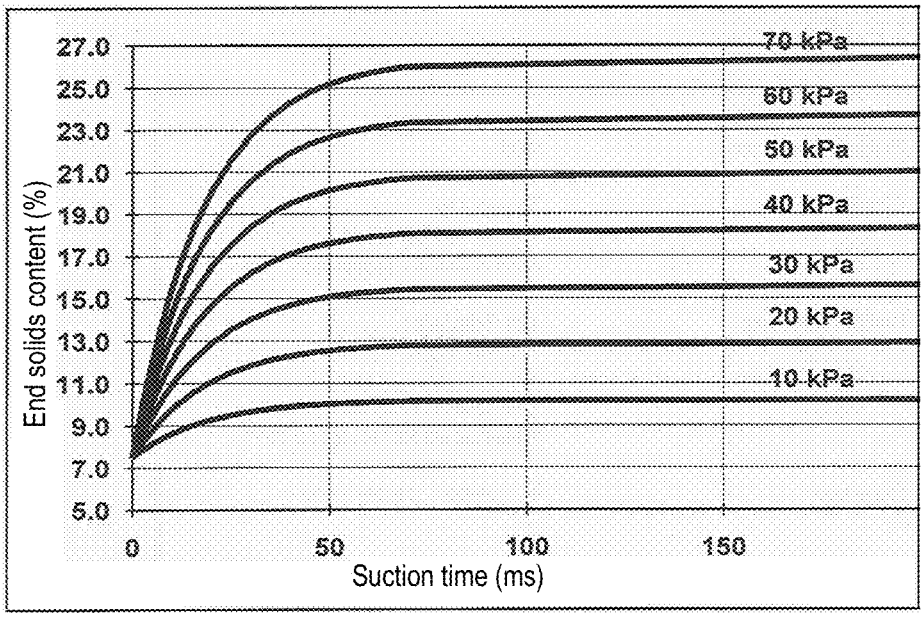
FIG. 4 shows change of solids content as a function of vacuum level and dwell time.

The cost of the turboblower 10 is dictated by the number of impellers (i.e., blower stages or steps), as well as by the foundation and auxiliary equipment costs thereof. As to investment costs, the hybrid vacuum system is clearly more profitable than prior art systems. Investment costs are about 20-40 percent lower than in the system illustrated in FIG. 2.

Figure 5:
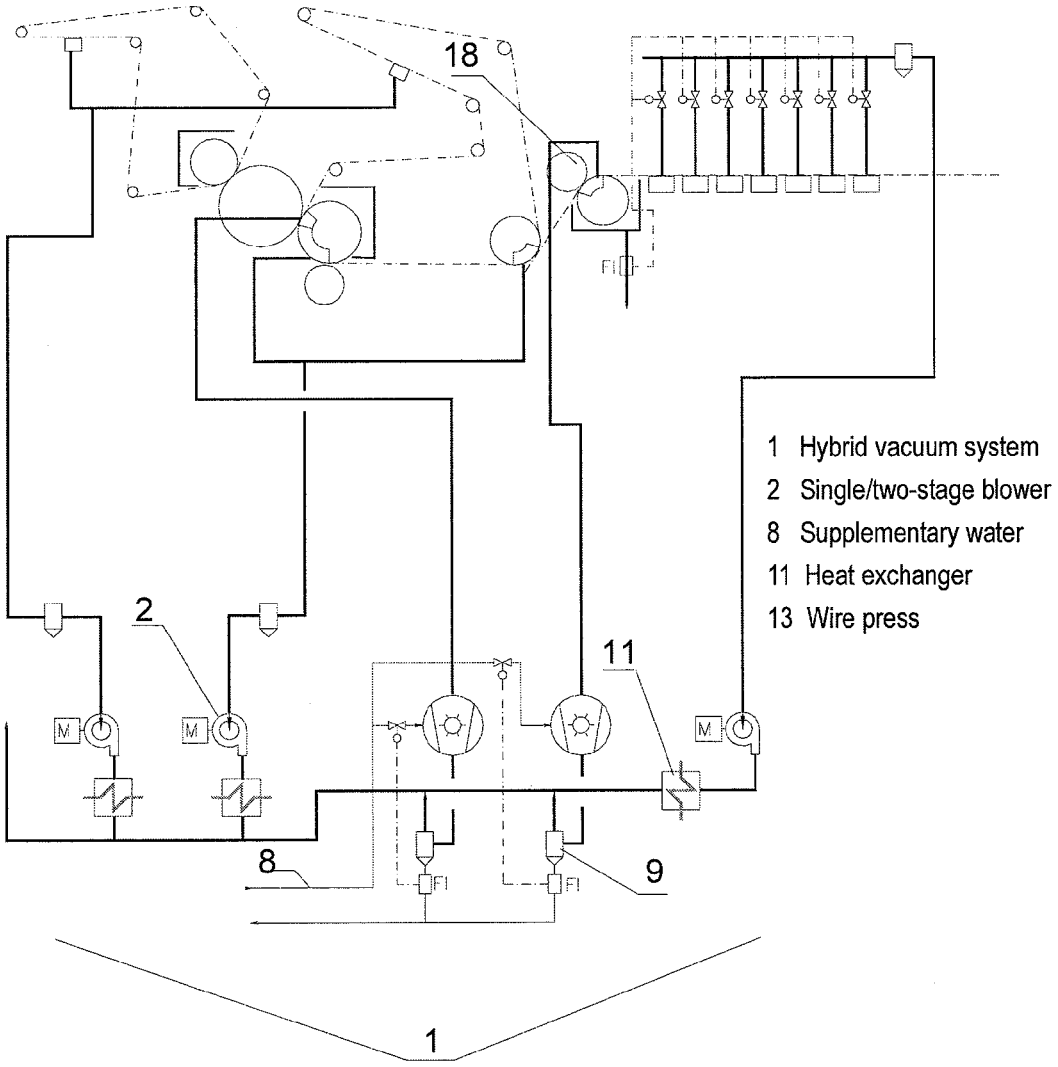
FIGS. 5 and 7 show some embodiments of an arrangement according to the invention.

Energy efficiency is also enhanced by way of passing the hot discharge gas exiting from the turboblowers 10 via heat exchangers 11 to the ambient. In appended FIG. 5 is illustrated the flow diagram of the hybrid vacuum system 1. Recovered thermal energy is 50-60 percent of electricity input. The recovered heat is used for preheating the intake air or fresh water inflow of the mill.

Figure 6:
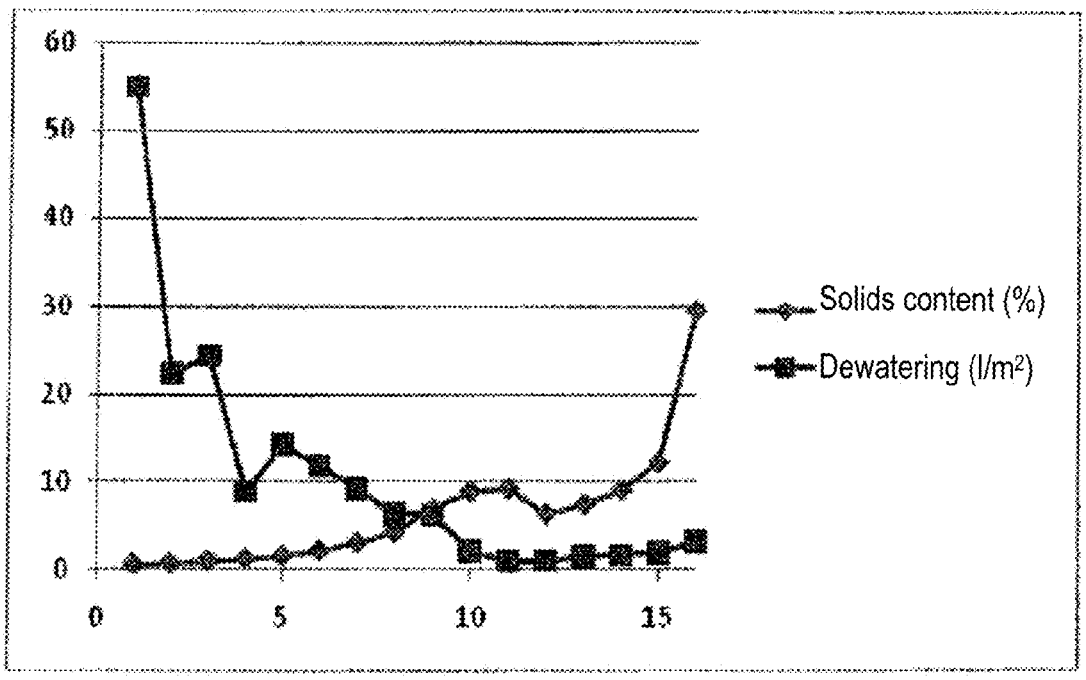
FIG. 6 shows the results of a solids content measurement on a double-layer wire section.

In appended FIG. 6 is shown the maximization results of the solids content on the wire section. The measurement has been carried out in a practical test performed on a paper machine equipped with another energy utilization enhancement scheme according to the present invention. The solids content measurement plotted in FIG. 6 was performed on a two-layer wire section having 16 pcs. of dewatering elements (on the lower wire). In the diagram is depicted the measurement of solids content and water removal on the wire section 12. At the end of wire section 12, downstream of wire suction roll 3, a solids content of 30 percent is attained. An essential prerequisite to this end is that the solids content shall be about 10 percent upstream of the wire suction roll 3.

This process behavior can be traced to the configuration in which above the wire suction roll 3 is adapted a wire press roll 18, running unfelted. Rewetting is a common phenomenon known to hamper the operation of a felted press. When the press nip opens, water reflows from the felt back to the web. This rewetting is the stronger the wetter the web. Consequently, a felted wire press roll cannot reach as high a solids content as a press having a smooth and unfelted press roll 18. In the configuration illustrated in FIG. 5, the wire suction roll 3 is further mounted at the end portion of the vacuum chamber 14 of the wire suction roll 3. With the help of a water ring pump 4, the interior space of the wire suction roll 3 is kept at a maximized vacuum level of about 70-75 kPa. The unfelted, wire press roll 18 covers a portion of the wire suction roll 3 thus reducing water flow through the web to the wire suction roll 3. However, these arrangements alone are not sufficient for attaining a desired solids content. This requires more effective water removal. In practice, when water is transferred from the web or wire to the suction holes 15 of the wire suction roll 3, the entrained air lands the water as a thin film onto the rims of the holes 15. Then, water cannot properly be expelled centrifugally from the roll, but rather forms a "mist" about the roll 3. Instead, when a sufficient amount of water is present, the unfelted, wire press roll 18 forces the water into the holes 15 of the wire suction roll 3 as a water plug 16 that readily leaves the roll 3 centrifugally.

Figure 7:
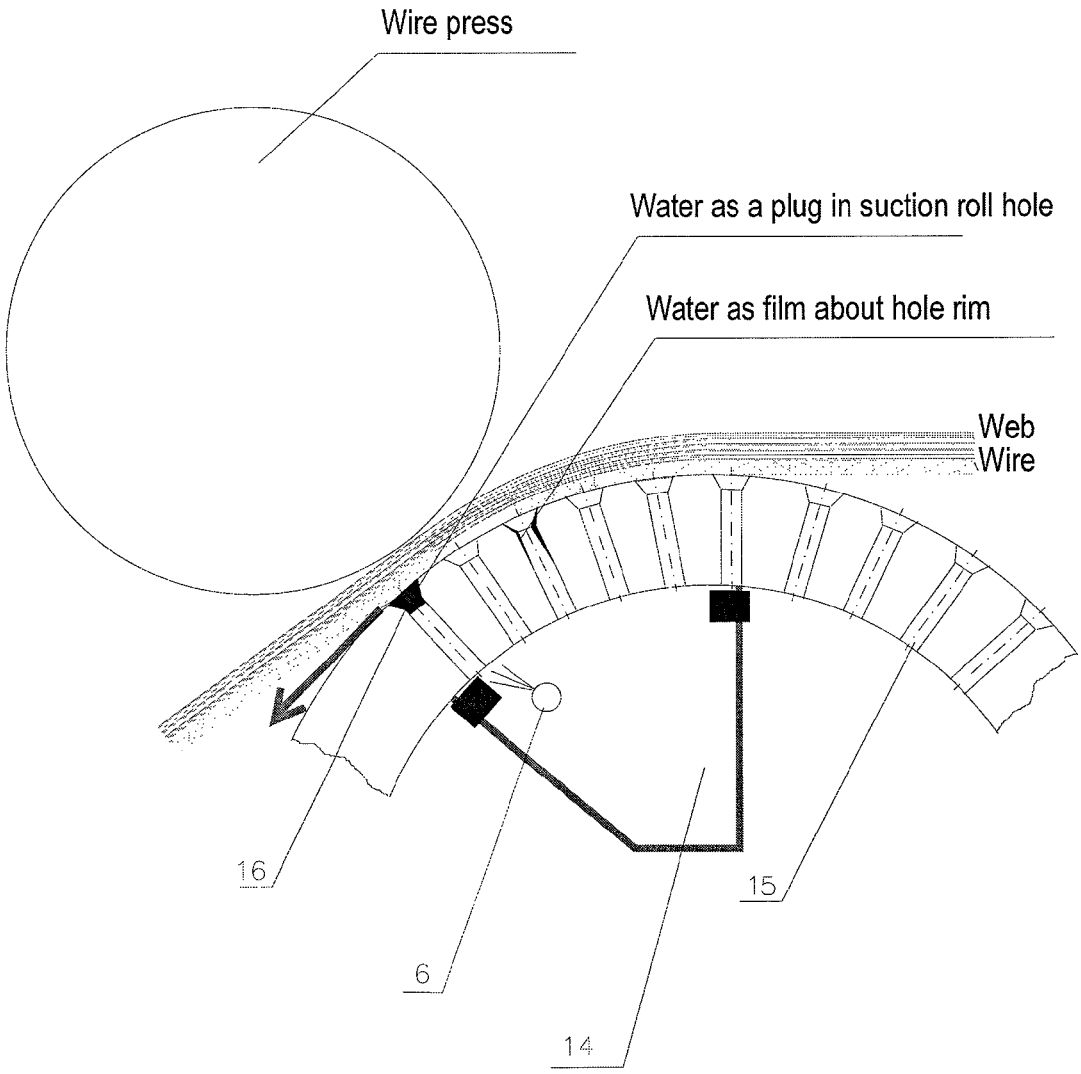

In FIG. 7 is illustrated the principle of water removal as well as the water film and water plug 16. The most advantageous precondition for forming a water plug 16 is that each of the holes 15 of the wire suction roll 3 is straight-walled without a beveled rim. The minimum amount of water can be estimated when the open surface area of the wire suction roll 3 is known. In a practical arrangement, the discharge pipe of the water collection pan of the wire suction roll 3 is provided with a flow meter. By practical tests, a set value is determined for the flow. With the help of this set value of water flow, the vacuum level of flat suction box 17 preceding the roll can be controlled in order to pass a desired amount of water to be removed at the wire suction roll 3. Then, there is no need to elevate the vacuum level of suction boxes 17 unnecessarily, whereby savings are attained in the energy consumption of the vacuum pump and the wire drive motors. This kind of operation is entirely different from that today used in the prior art, wherein the goal is to maximize the solids content increase at each water removal element. The control scheme of the wire suction roll 3 and the flat suction boxes is illustrated in FIG. 5.

As an additional verification of the concept, the table below proves how the arrangement according to the invention achieves higher solids content down-stream of the press and thus reduces steam consumption on the dryer section.

As listed below, typical distribution of water removal percentages on the press section in a three-nip press divides as follows: first press 20 percent, second press 50 percent and third press 30 percent. In the table is also estimated the increase of solids content for two cases wherein downstream of the wire the solids content is 20 percent and 30 percent, respectively (with the assumption that each 1 percent increase downstream of the wire causes a 0.25 percent increase downstream of the press).

Results obtained from a paper machine illustrated in FIG. 5 are listed below.

| | Prior art paper machine | Arrangement acc. to invention. |
|---|---|---|
| Wire solids content (%) | 20 | 30 |
| Press solids content (%) | 46 | 48.5 |

-continued

| | Prior art paper machine | Arrangement acc. to invention. |
|---|---|---|
| Press water removal (l/min) | 1000 | 450 |
| at press #1 | 200 | 0 |
| at press #2 | 500 | 270 |
| at press #3 | 300 | 180 |

As is evident from the table, the arrangement according to the invention achieves a higher solids content downstream of the press and resultingly provides a substantial reduction of steam consumption on the dryer section. A salient feature is that as the solids content increases by 10 percent downstream of the wire, it is possible to obtain a higher solids content downstream of the press even if the number of felts is reduced from three to two.

The present arrangement offers substantial benefits by optimizing the different individual elements in a novel way into an overall solution disclosed in the invention. The essential feature of the invention is that, on the paper machine wire section 12, water is removed with the help of a hybrid vacuum system 1 serving first the vacuum locations needing a lower vacuum level and then those requiring a higher vacuum level. Additionally, the solids content on the wire section 12 is optimized with the help of an unfelted, wire press roll 18 adapted above the wire suction roll 3 and finally at the other vacuum locations of the paper machine 5 in such a fashion that water removal is carried out at different sections of the paper machine 5 with the help of different vacuum systems running them at their optimal energy efficiency levels.

The hybrid vacuum system 1 is more particularly implemented so that single-stage or two-stage blowers 2 are run at their optimal energy efficiency speed to serve vacuum locations needing a lower vacuum level, typically at a vacuum of 0-60 kPa. Water removal at locations requiring a higher vacuum is carried out with the help of a water ring pump 4 at a vacuum level of about 70-75 kPa, while other vacuum locations are served by speed-controlled turboblowers 10. Simultaneously, the solids content on the wire section 12 is optimized by mounting above the wire suction roll 3, and an unfelted press roll 13 located at the end portion of the vacuum chamber 14 of the wire suction (vacuum) roll 3. A further essential feature is that the unfelted, wire press roll 18 forces water into holes 15 of wire suction roll 3 so as to form water plugs 16 therein thus further increasing the solids content. The overall result is a combined use according to the invention of a hybrid vacuum system 1 and optimization of solids content on the wire section 12, in order to reduce water and energy consumption on a paper machine 5.

To a person skilled in the art it is obvious that the invention is not limited by the above-described exemplary embodiments, but rather may be varied within the inventive spirit and scope of the appended claims.

What is claimed is:

1. A method for reducing water and energy consumption of a paper machine with a hybrid vacuum system and optimization of a solids content, comprising the steps of:

initially removing the water on a wire section of the paper machine with the hybrid vacuum system serving vacuum locations needing a lower vacuum level of 0-60 kPa, and then removing the water on other locations of the paper machine requiring a higher vacuum level of 70-75 kPa, thereby rendering individually maximized energy efficiency when removing the water on each of the wire section and on the other locations of the paper machine, and optimizing the solids content on the wire section by using a smooth, unfelted press roll, the method further comprising:

using a speed-controlled, single-stage or a two-stage turboblower to serve the vacuum locations needing the vacuum level, while bringing the vacuum level to the higher level of with use of a water ring pump, and using the smooth, unfelted press roll to force the water into holes of a wire suction roll so as to form water plugs, thereby further enhancing the solids content using seal strip lubrication water to seal the water of the water ring pump, while metering required supplementary water, either at a water separator located downstream of the water ring pump, or by monitoring a temperature of the water ring pump, thereby returning the water leaving the water separator to process, or using the water leaving the water separator as cleaning shower water, and passing hot discharge gas exiting from the turboblowers via heat exchangers to ambient.

2. The method of claim 1, wherein the hybrid vacuum system includes the speed-controlled, single-stage turboblowers or two-stage turboblowers, and the smooth, unfelted press roll is located at an end portion of a vacuum chamber above the wire suction roll, the method further comprising:

operating a hybrid vacuum system at the lower vacuum level in order to remove the water on the vacuum locations of the wire section of the paper machine that need the lower vacuum level, and operating the hybrid vacuum system at the higher vacuum level along with the water ring pump in order to remove the water on the other locations of the paper machine that require the higher vacuum level, while simultaneously optimizing the solids content on the wire section by mounting the unfelted press roll above the wire suction roll.

3. The method of claim 1, the method further comprising:

using the two-stage turboblower to serve the vacuum locations needing the lower vacuum level of 0-60 kPa, wherein the holes of the wire suction roll are straight-walled.

4. The method of claim 1, the method further comprising:

using seal strip lubrication water to seal the water of the water ring pump, while metering required supplementary water, either at a water separator located downstream of the water ring pump, or by monitoring a temperature of the water ring pump, thereby returning the water leaving the water separator to a process, or using the water leaving the water separator as cleaning shower water, and passing hot discharge gas exiting from the turboblowers via heat exchangers to ambient.

5. An apparatus for reducing water and energy consumption of a paper machine with a vacuum system and optimization of solids content on a wire section of the paper machine, wherein the apparatus comprises:

a hybrid vacuum system adapted to operate in combination with a smooth, unfelted press roll located above a wire suction roll, and speed-controlled, single-stage or two-stage turboblowers adapted to serve vacuum locations needing a lower vacuum level of 0-60 kPa, a water ring pump adapted to elevate the vacuum level to a higher vacuum level of 70-75 kPa with the water ring pump, wherein the smooth, unfelted press roll is adapted to force the water into holes of the wire suction roll so as to form water plugs, thereby further enhancing the solids content seal strip lubrication water adapted to seal the water of the water ring pump, while metering required supplementary water, either at a water separator located downstream of the water ring pump, or by monitoring a temperature of the water ring pump, to return the water leaving the water separator to a process, or to use the water leaving the water separator as cleaning shower water, and to pass the hot discharge gas exiting from the turboblowers via heat exchangers to ambient.

6. The apparatus of claim 5, wherein the unfelted press roll is located at an end portion of a vacuum chamber of the wire suction roll.

7. The apparatus of claim 6, wherein hybrid vacuum system comprises:

impellers of the turboblowers mounted on a motor shaft of a water ring pump, the impellers being adapted to control rotational speed of the turboblowers.

8. The apparatus of claim 5, wherein the hybrid vacuum system comprises:

impellers of the speed-controlled turboblowers mounted on a motor shaft of the water ring pump, the impellers being adapted to control rotational speed of the turboblowers.

9. The apparatus of claim 5, wherein the hybrid vacuum system includes the speed-controlled, single-stage turboblowers or two-stage turboblowers are adapted to pass hot discharge gas exiting from the turboblowers via heat exchangers to ambient.

10. The apparatus of claim 5, wherein the two-stage blowers is used to serve the vacuum locations needing the lower vacuum level of 0-60 kPa, and the holes of the wire suction roll are straight-walled.

11. A method for using a hybrid vacuum system to increase solids content on a wire section of a paper machine, the method comprising the steps of:

initially removing water on a wire section of the paper machine with a hybrid vacuum system serving vacuum locations needing a lower vacuum level of 0-60 kPa, and then removing the water on other locations of the paper machine requiring a higher vacuum level of 70-75 kPa, using a single-stage or a two-stage turboblower to serve the vacuum locations needing the lower vacuum level, while bringing the vacuum level to the higher vacuum level with use of a water ring pump, and using a smooth, unfelted press roll above a wire suction roll to force the water into holes of the wire suction roll to form water plugs, thereby increasing the solids content on the paper machine to 48.5% using seal strip lubrication water to seal the water of the water ring pump, while metering required supplementary water, either at a water separator located downstream of the water ring pump, or by monitoring a temperature of the water ring pump, thereby returning the water leaving the water separator to process, or using the water leaving the water separator as cleaning shower water, and passing hot discharge gas exiting from the turboblowers via heat exchangers to ambient.

12. The method claim 11, the method further comprising:

controlling the solids content on the paper machine to 48.5% by mounting the unfelted press roll located at an end portion of a vacuum chamber of the wire vacuum roll above the wire suction roll.

* * * * *